US007635071B1

(12) United States Patent
Montgomery et al.

(10) Patent No.: US 7,635,071 B1
(45) **Date of Patent: *Dec. 22, 2009**

(54) DOUBLE SHELL DISPENSING CLOSURE WITH A REVERSE TAPERED DROP LUG

(75) Inventors: Gary V. Montgomery, Evansville, IN (US); Christopher B. Clodfelter, Evansville, IN (US); William D. Sprick, Evansville, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 267 days.

This patent is subject to a terminal disclaimer.

(21) Appl. No.: 11/737,513

(22) Filed: Apr. 19, 2007

Related U.S. Application Data

(63) Continuation-in-part of application No. 11/463,324, filed on Aug. 9, 2006.

(51) Int. Cl.
*B65D 41/04* (2006.01)

(52) U.S. Cl. ..... 222/546; 222/556; 215/331

(58) Field of Classification Search ..... 215/216–219, 215/330–331; 220/254.3, 291; 222/546, 222/556

See application file for complete search history.

(56) References Cited

U.S. PATENT DOCUMENTS 3,233,769 A * 2/1966 Jessop ..... 215/216
4,099,639 A * 7/1978 Boxer et al. ..... 215/209
4,117,945 A * 10/1978 Mumford ..... 215/216
4,241,856 A * 12/1980 Otterson ..... 222/539
4,805,807 A 2/1989 Perne et al.
5,111,949 A 5/1992 Ambrosi et al.
5,199,605 A 4/1993 Schneider
6,062,441 A 5/2000 Mengeu et al.
6,065,648 A 5/2000 Tauber
6,543,650 B1 4/2003 Sprick et al.
6,669,063 B1 12/2003 Schneider et al.
2004/0031814 A1 * 2/2004 Harriman et al. ..... 222/107
2005/0061765 A1 * 3/2005 Skillin et al. ..... 215/235
2007/0187351 A1 * 8/2007 Robinson ..... 215/237

* cited by examiner

*Primary Examiner*—Kenneth Bomberg
(74) *Attorney, Agent, or Firm*—Chad D. Bruggeman; John F. Salazar; Middleton Reutlinger

(57) ABSTRACT

The dispensing closure is provided having a stopping mechanism that limits the rotation of the closure and generally prevents removal of the closure from the container. The dispensing closure includes a cap body, fitment, and container finish. The cap body has a double shell design, which includes at least one drop lug reverse tapered from the inner shell. When the cap body is rotated about the container finish, the reverse tapered drop lug engages at least one lug stop located on the container finish so as to limit the rotation, thereby preventing removal of the cap body from the container finish. The reverse taper of the drop lug maximizes the abutment surface and stability of the drop lug when engaging the corresponding lug stop.

6 Claims, 18 Drawing Sheets

DOUBLE SHELL DISPENSING CLOSURE WITH A REVERSE TAPERED DROP LUG

CROSS-REFERENCE TO PRIOR APPLICATION

This application is a continuation-in-part of and claims priority to and benefit from, currently pending, U.S. patent application Ser. No. 11/463,324, filed on Aug. 9, 2006.

TECHNICAL FIELD

The present invention relates to a dispensing closure and particularly to a double shell dispensing closure with a stopping mechanism.

DETAILED DESCRIPTION

Figure 1:
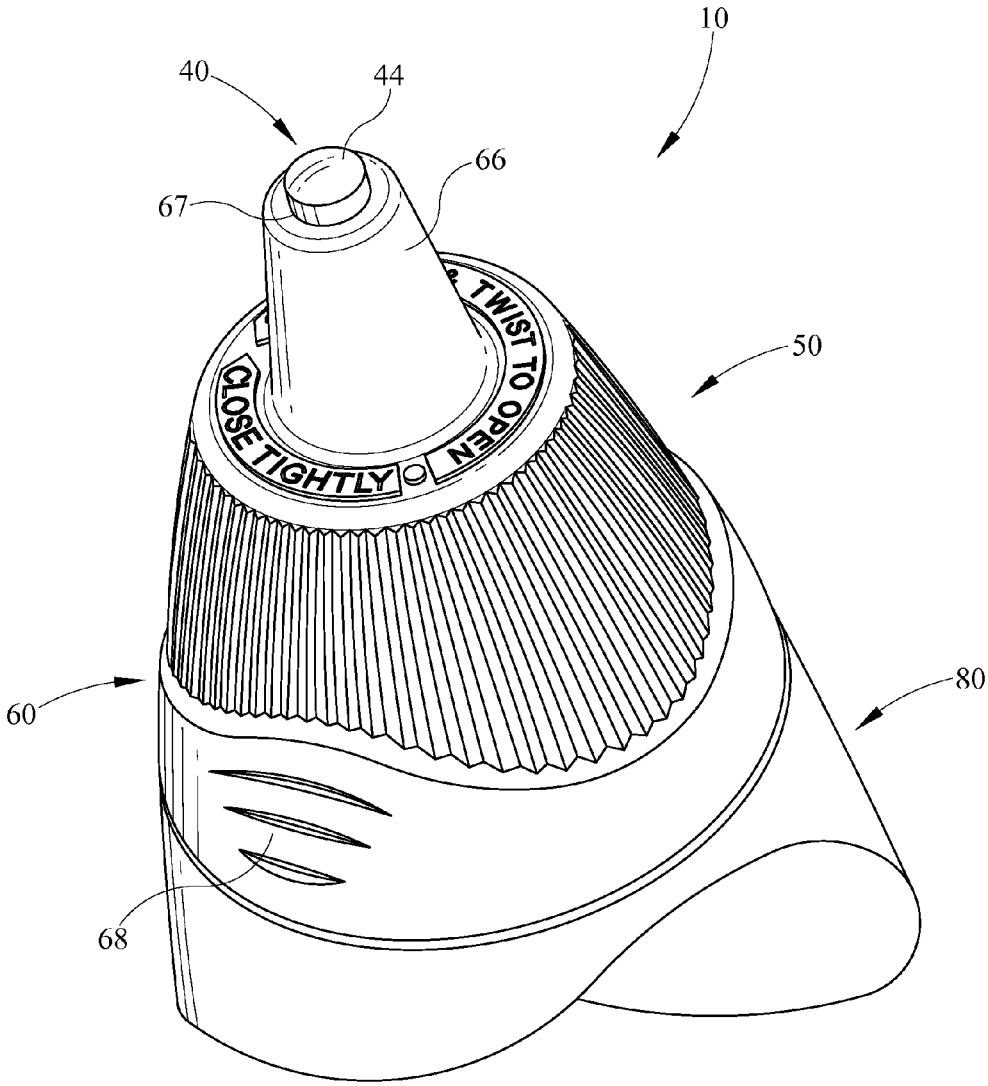
FIG. 1 is a top perspective view of the closure according to one embodiment with the container partially broken away.

As shown in the FIGS. 1-14, one embodiment of a double shell closure is provided having a dispensing feature with a stopping mechanism which facilitates the dispensing of the contents of a tube, bottle or similar container, but prevents removal of the closure from the container. Closure 10 may be formed of any material well known in the art, such as polypropylene and polyethylene. As shown in FIG. 1, the closure 10 may include a cap body 50, a fitment 40 and a container finish

80. The cap body 50 is threadably attached to the container finish 80, so that the cap body 50 may threadably rotate axially along the neck portion 82 of the container finish 80. In this manner, the cap body 50 may be rotated from a closed position to an open position in order to access the contents of the container (not shown) upon which the container finish 80 is disposed. The fitment 40 is positioned within closure 10 so that the opening 67 in the spout portion 66 of the cap body 50 is sealed by the post 44 of the fitment 40, when the cap body 50 is in the closed position. The embodiment also provides a stopping mechanism by which the rotation of cap body 50 about container finish 80 is limited. This stopping mechanism prevents the threadable removal of the cap body 50 from the container finish 80.

Figure 2:
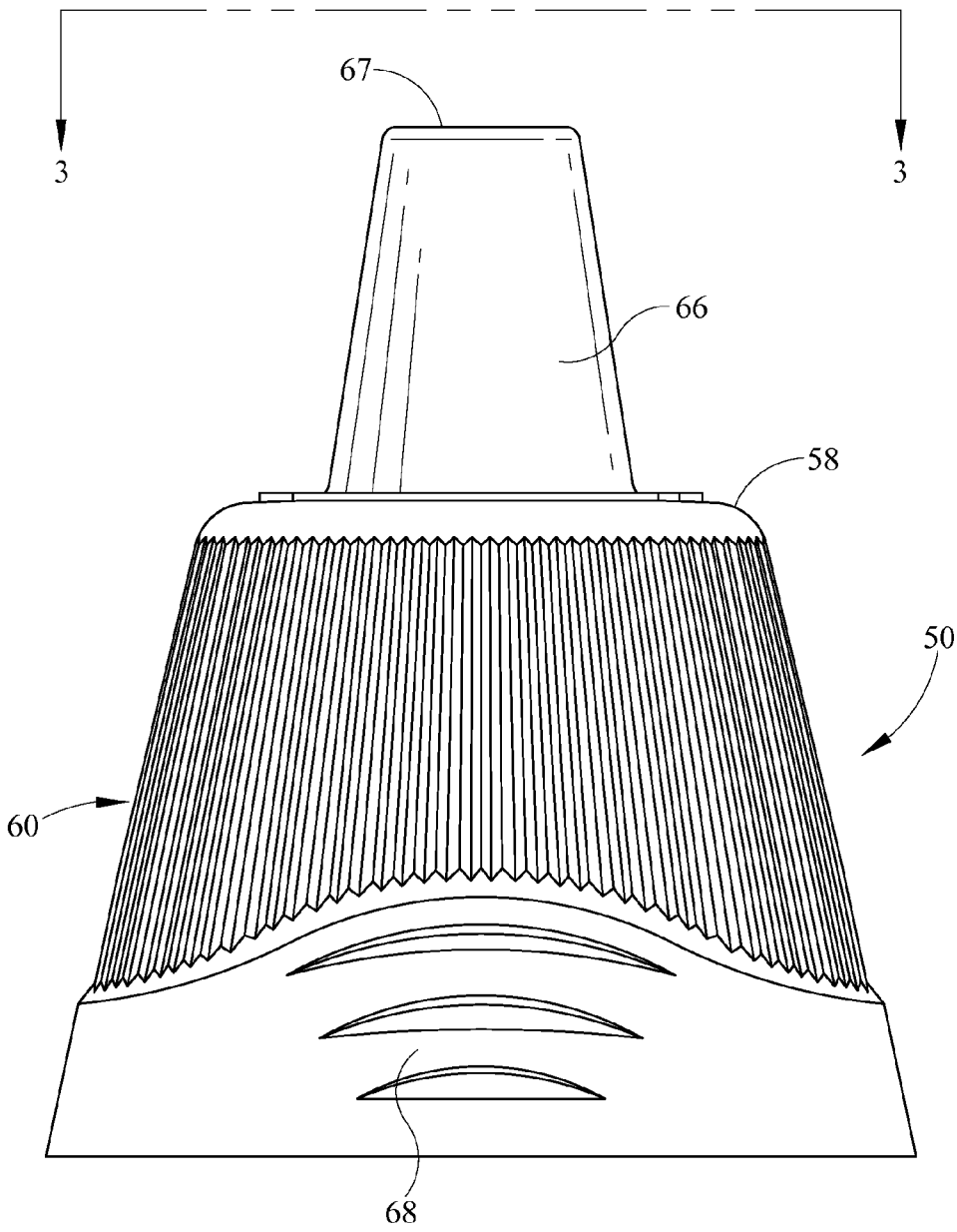
FIG. 2 is a side view of the cap body of the closure of FIG. 1.
Figure 3:
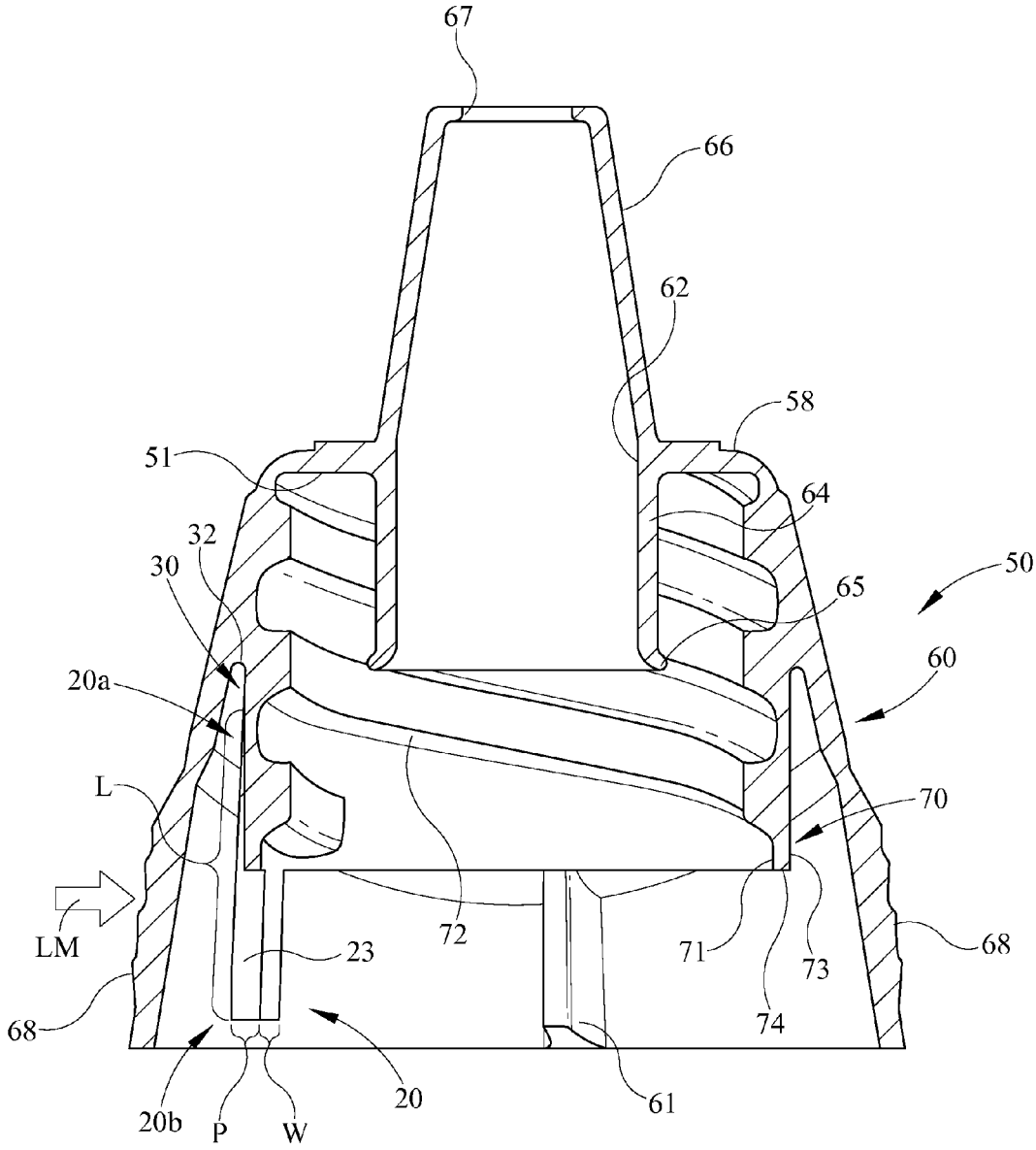
FIG. 3 is a sectional view of the cap body of FIG. 2 taken along line 3-3.
Figure 6:
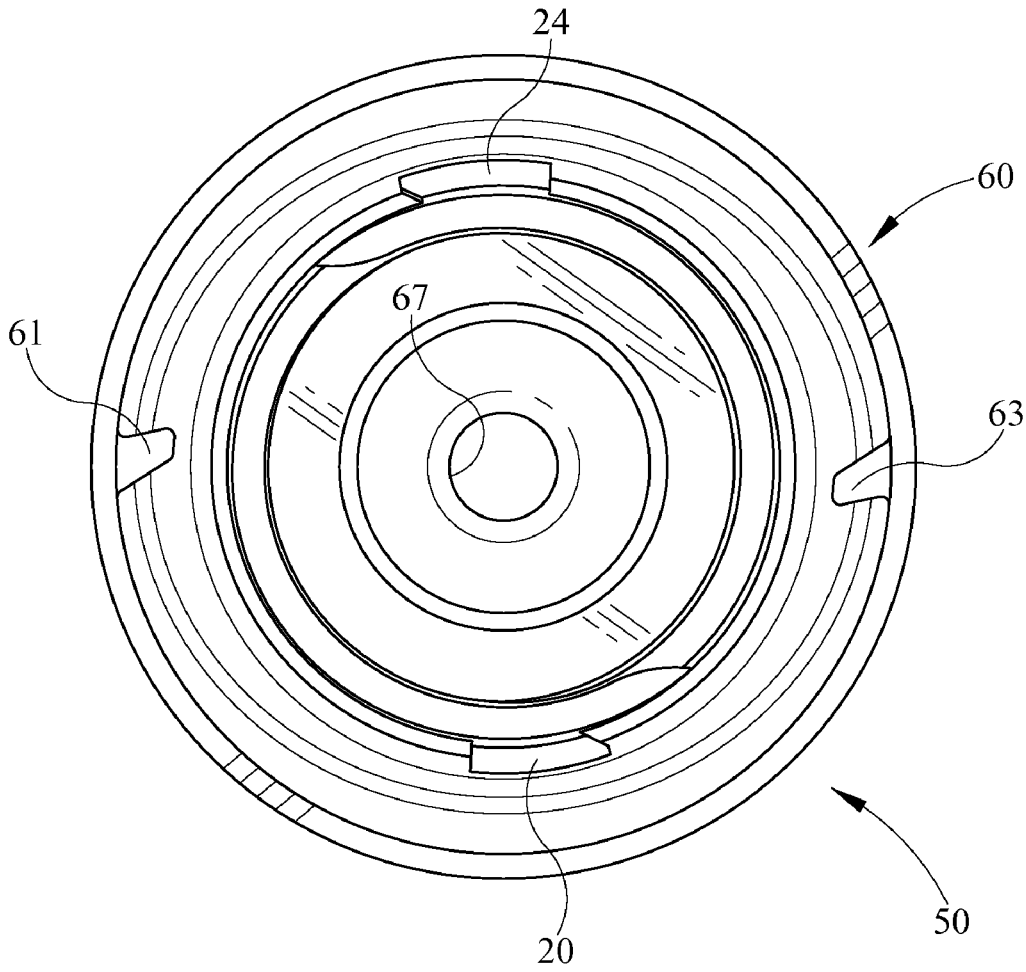
FIG. 6 is a bottom view of the cap body of FIG. 2.
Figure 14:
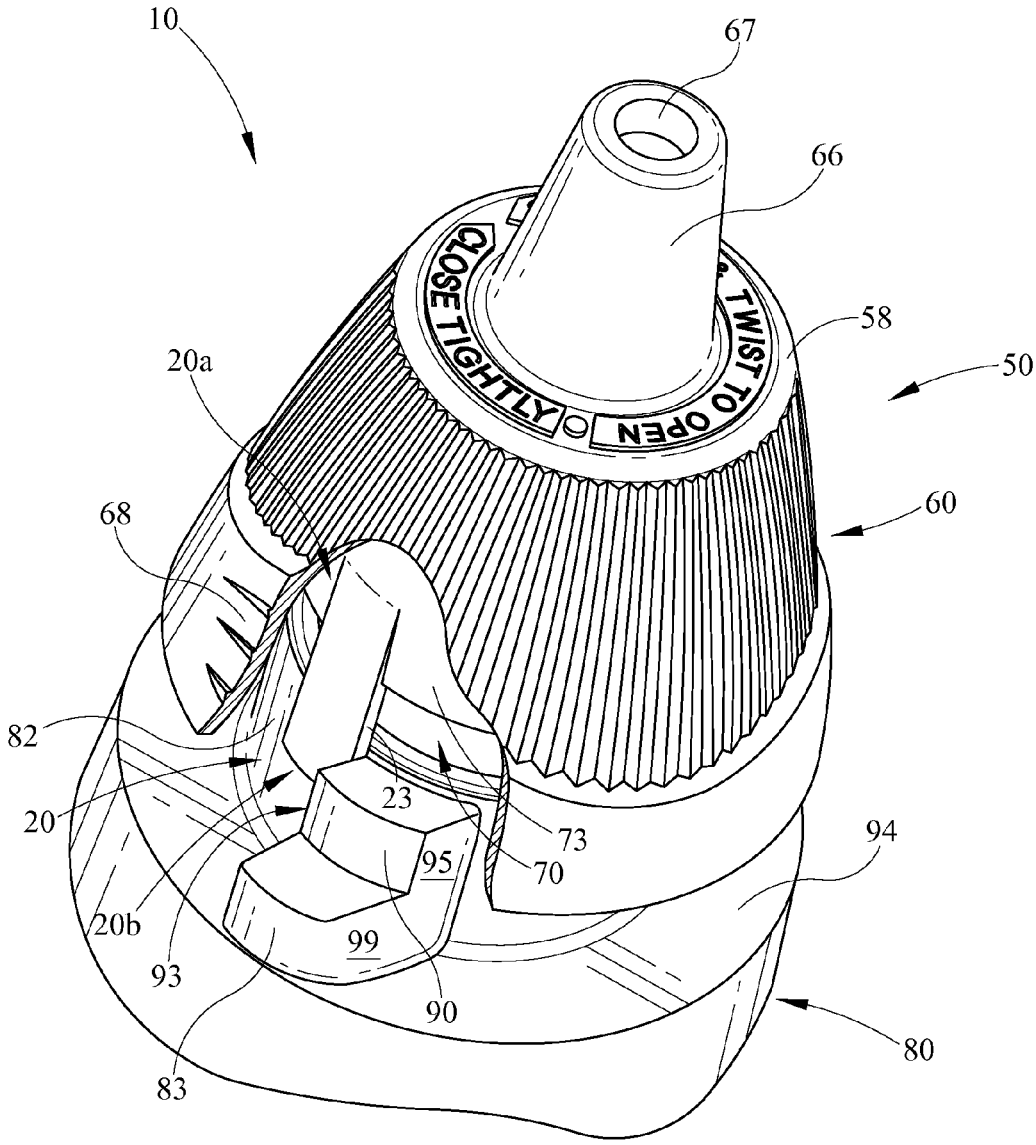
FIG. 14 is a top perspective view of the closure and container finish with portions of the closure partially broken away.

As shown in FIG. 2, the cap body 50 includes an outer shell or wall 60 depending from a top wall 58 from which projects a spout portion 66. Spout portion 66 includes an opening 67 from which the contents of a container (not shown) may be dispensed. As shown in FIG. 3, cap body 50 includes an inner shell or wall 70, in addition to outer wall 60. Outer wall 60 may be substantially conical or any other appropriate shape. Inner wall 70 is substantially annular and may include at least one thread 72 projecting from an inner surface 71 thereof. The stopping mechanism includes at least one drop lug 20 reverse tapered and projecting down from an outside surface 73 of inner wall 70 and may pass through a lower portion or termination edge 74 of inner wall 70. A top end 20*a* of drop lug 20 merges or tapers into outside surface 73 of inner wall 70. As shown in FIGS. 3 and 14, reverse taper drop lug 20 is generally wedge-shaped, although other tapered shapes are contemplated within the scope of the invention. In one embodiment, outside surface 73 of inner wall 70 includes two reverse tapered drop lugs 20 and 24 projecting downwardly therefrom. As shown in FIG. 6, drop lugs 20 and 24 are diametrically disposed from inner wall 70. However, drop lugs 20, 24 may be disposed in any alignment in which the rotation of cap body 50 is usefully limited. However, when drop lug 20 meets lug stop 90 or 92 on container finish 80 as discussed herein below, the shape of drop lug 20 and the extent of its attachment to inner wall 70 should be sufficient to oppose twisting force applied by the user. As shown in FIGS. 3 and 14, reverse tapered drop lug 20 is formed so as to resist deformation as rotational pressure is applied to cap body 50. Drop lug 20 engages lug stop 90 on container finish 80, when the closure 10 is rotated counterclockwise, so as to prevent rotation of cap body 50, as described herein below. As shown in FIG. 3, reverse tapered drop lug 20 is reverse tapered from inner wall 70 allowing for a larger profile P at terminating or bottom end 20*b* of the drop lug. Drop lug top end 20*a* merges into outside surface 73 of inner wall 70. The larger profile P at bottom end 20*b* creates an abutment surface 23 which has an increased surface area adapted to resist deformation as the rotational pressure increases once contact between the drop lug and lug stop begins. Deformation of drop lug 20 is also minimized by the gradual increase in profile P of the drop lug when reverse tapering from narrow to wide in the direction away from inner wall 70 for a length L. The extent of the reverse tapered connection between drop lug 20 and inner wall 70, including the overall width W and length L of the drop lug 20 and a larger profile P at bottom end 20*b*, imparts to drop lug 20 sufficient rigidity to resist deformation as rotating pressure is applied to cap body 50. Any number of dimensioning of width W, length L, and profile P for drop lug 20 having a reverse taper may be used and still fall within the spirit of an embodiment of the invention.

Figure 5A:
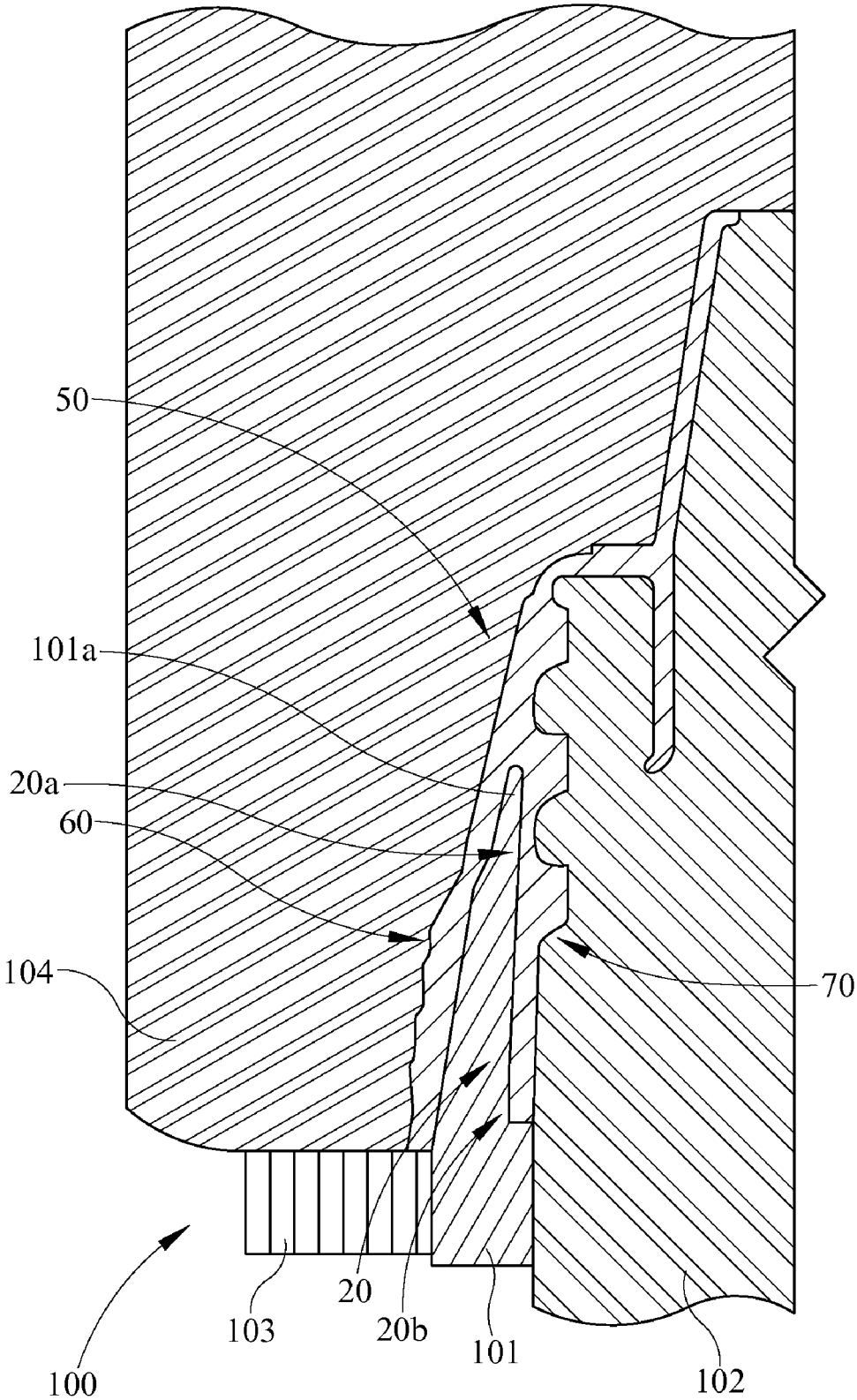
FIG. 5A is a partial sectional side view of the mold cavity with the inner and outer mold core elements completely received within the mold cavity after a closure has been formed therein.
Figure 5B:
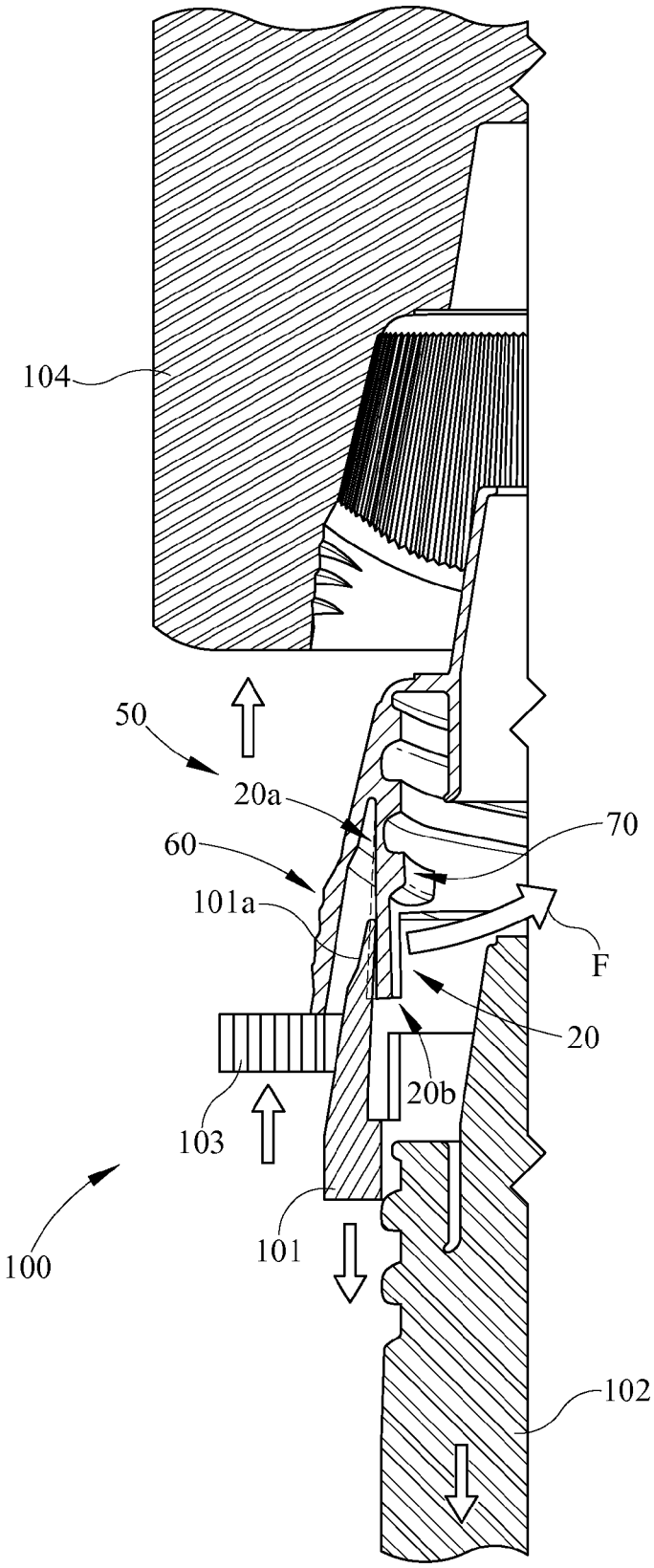
FIG. 5B is a partial sectional view of the mold cavity with the inner core element being rotated and backed out of the mold cavity and closure, and the outer core element being partially removed from the mold cavity.

With the formation of the reverse taper drop lug 20 from inner wall 70, bottom end 20*b* becomes an impediment to the extraction of outer core element 101 of a mold cavity 100. As illustrated in FIGS. 5A and 5B, cap body 50 with reverse tapered drop lug 20 may be formed in mold cavity 100 with the use of an inner core element 102, outer core element 101, a stripper ring 103, and unitary mold 104. As shown in FIG. 5A, mold cavity 100 has inner core 102 and outer core 101 elements completely received within unitary mold 104 after a double shell closure or cap body 50 with reverse taper drop lug 20 has been formed therein. Bottom end 20*b* of the reverse taper drop lug 20 precludes the axial removal of outer core element 101 from within cap body 50 in mold cavity's 100 closed configuration of FIG. 5A. As illustrated in FIG. 5B, the movable inner core 102 element may be axially withdrawn and rotated at a preselected amount while outer core 101 in cooperating relation with stripper ring 103 prevent cap body 50 from turning out of the mold cavity. Coinciding with the axial withdrawal and rotation of inner core 102, the unitary mold 104 is withdrawn in opposing direction of the withdrawal of the inner core until the inner core is substantially free of inner wall 70 of cap body 50 and the cap body is free of the unitary mold. Also illustrated in FIG. 5B, outer core element 101 may be axially withdrawn from cap body 50 after inner core 102 is rotated and backed out of the cap body. After inner core 102 is withdrawn from cap body 50, bottom end 20*b* of reverse taper drop lug 20 is no longer an impediment for the axial withdrawal of outer core 101 as a result of inner wall 70 comprising of a flex mechanism F. This flex mechanism F is adapted to allow inner wall 70 and reverse taper drop lug 20 to flex inwardly, allowing for outer core element 101 to be extracted. As outer core 101 is axially withdrawn from cap body 50, outer core 101 has an extremity 101*a* which passes into the plane of the newly formed cap body 50 flexing inwardly reverse taper drop lug 20 and/or inner wall 70. Outer core 101 continues to flex inner wall 70 and drop lug 20 with reverse taper inward until outer core element passes out of contact with the inner wall and reverse tapered drop lug. Stripper ring 103 works in cooperating relation with outer core 101 to remove cap body 50 from the outer core. Stripper ring 103 performs the function of stripping cap body 50 from outer core 101. Note that cap body 50 is substantially withdrawn from unitary mold 104 before the stripping ring 103 is actuated to enable the molded cap to fall from mold cavity 100. Flex mechanism F may be created at least in part by the newly created closure article being in a substantially malleable condition and/or the minimized wall thickness of inner wall 70 and reverse tapered drop lug 20.

Figure 4:
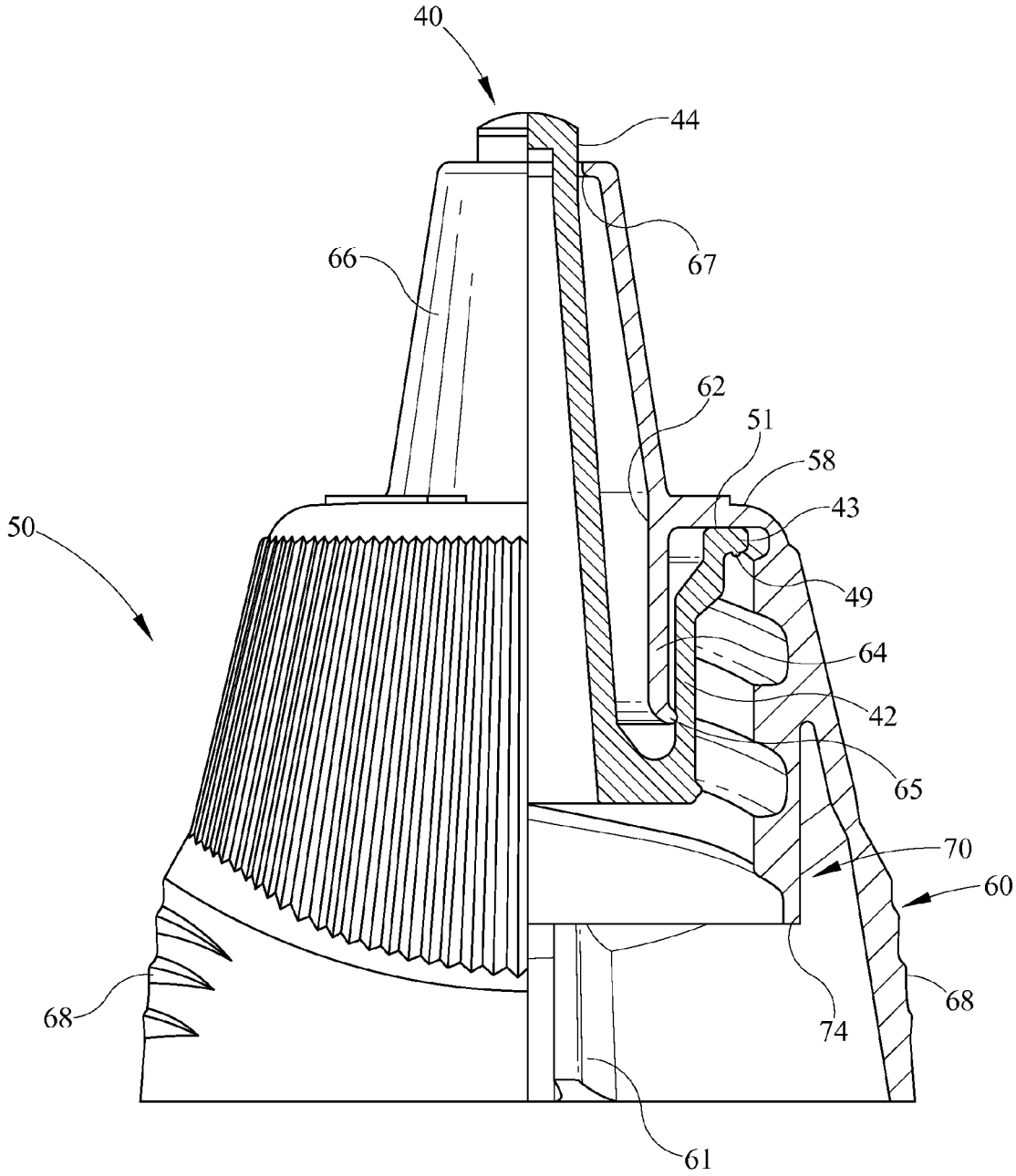
FIG. 4 is a side view of the cap body and fitment according to one embodiment with portions partially broken away.

As shown in FIGS. 3 and 4, outer wall 60 may include at least one child-resistant lock 61 formed thereon. In one embodiment, as shown in FIGS. 3 and 6, cap body 50 includes two child-resistant locks 61 and 63 diametrically aligned along outer wall 60. Cap body 50 also includes a top wall 58 from which both inner wall 70 and outer wall 60 generally depend from. Top wall 58 includes an opening 62 disposed therein. A spout portion 66 projects from top wall 58 and is coaxially aligned with opening 62. Indeed, inner wall 70 and outer wall 60 are also coaxially aligned with opening 62. In one embodiment, as shown in FIGS. 3 and 4, cap body 50 includes a skirt 64 depending from top wall 58 flush with opening 62. Skirt 64 is provided within cap body 50 so as to operably engage an annular wall 42 of fitment 40, as shown in FIG. 4. In one embodiment, skirt 64 includes a skirt sealing bead 65 which engages annular wall 42. By this engagement, the contents of the container (not shown), to which the closure 10 is attached, are prevented from contacting inner wall 70.

Figure 7:
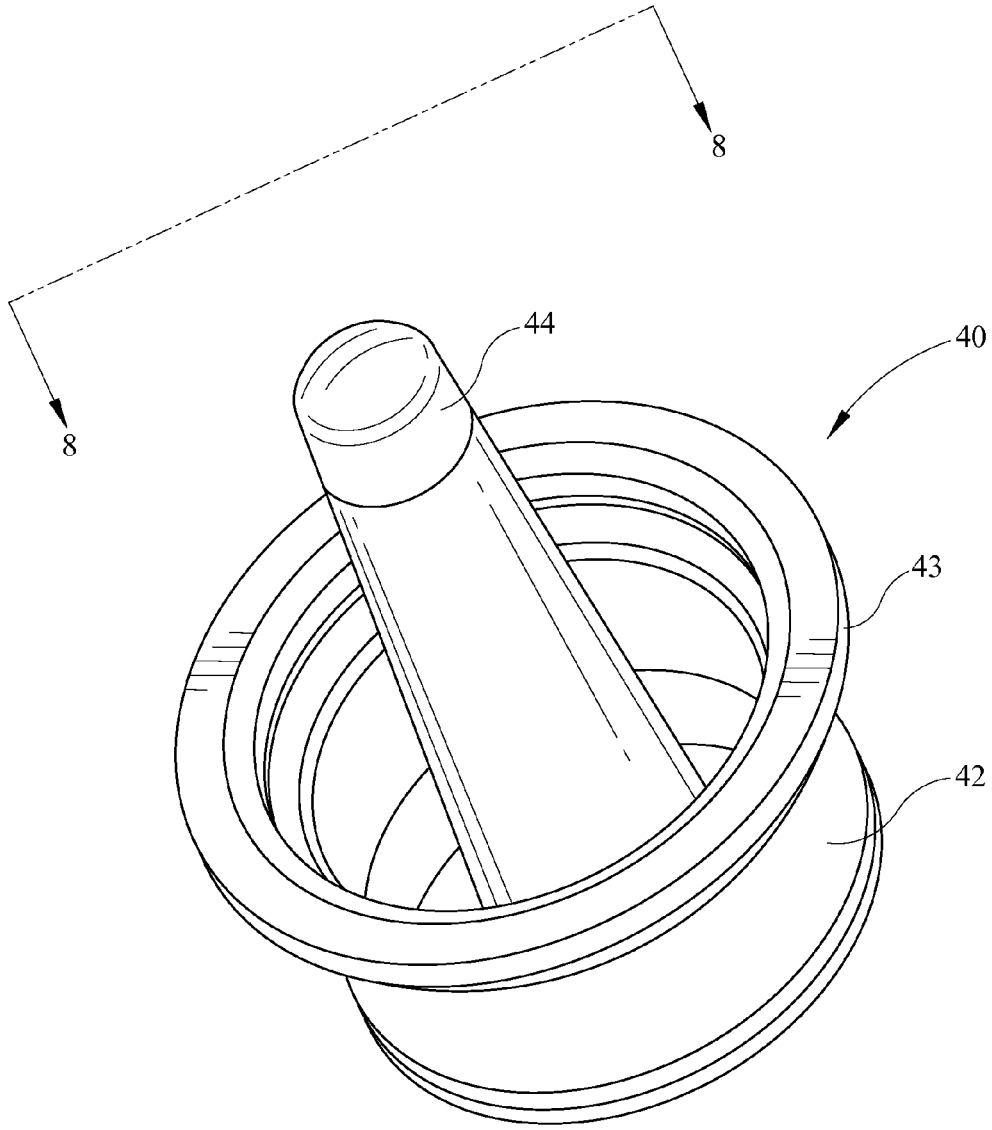
FIG. 7 is a top perspective view of the fitment of an embodiment of the closure.
Figure 8:
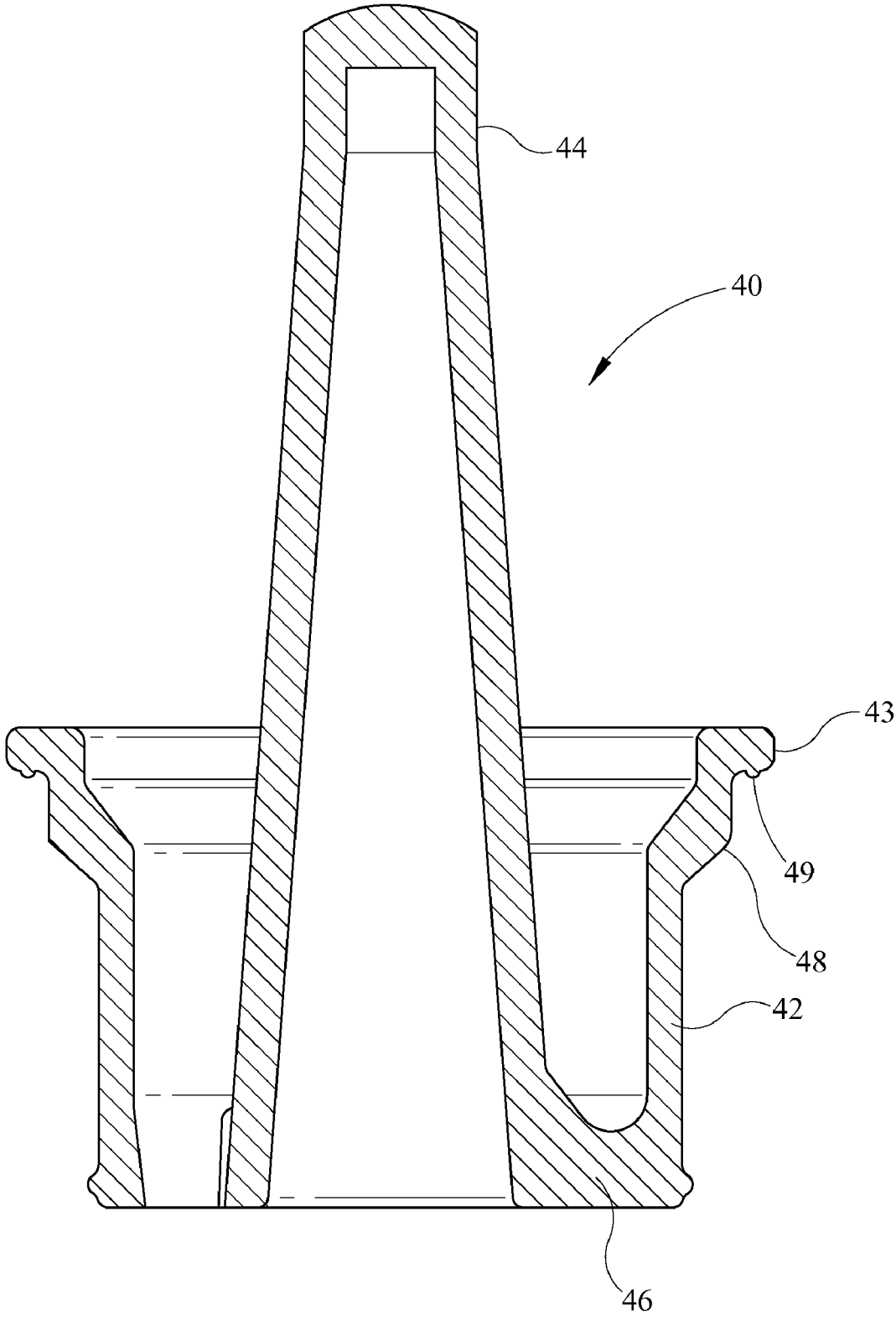
FIG. 8 is a sectional view of the fitment of FIG. 7 taken along line 8-8.
Figure 9:
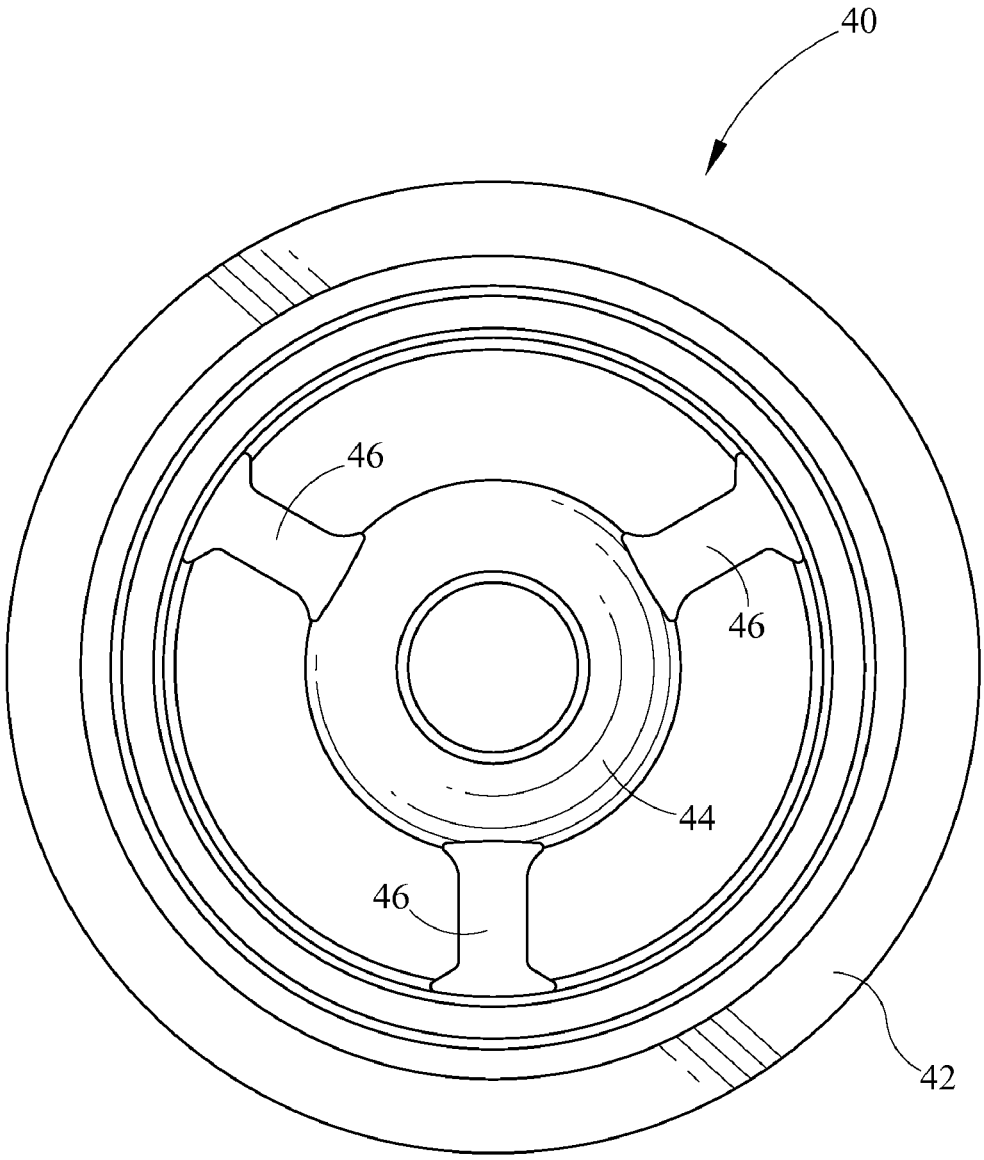
FIG. 9 is a bottom view of the fitment of FIG. 7.

As shown in FIG. 4, cap body 50 and fitment 40 cooperate to provide a double sealing mechanism, which includes the top wall sealing bead 51, flange 43, annular wall 42 and skirt sealing bead 65. A first seal is provided by the engagement of skirt sealing bead 65 contacting annular wall 42, as shown in FIG. 4. Skirt sealing bead 65 is disposed so as to sealably engage annular wall 42 throughout the range of axial rotation through which the cap body 50 may rotate. The first seal formed by skirt sealing bead 65 and annular wall 42 prevents the contents of the container (not shown) from leaking past skirt 64. A second seal is formed by the engagement of top wall sealing bead 51 and flange 43, as shown in FIG. 4. This second seal is forced only when the cap body 50 is in a generally closed position, since top wall 58 must be adjacent to flange 43 in order for top wall sealing bead 51 to engage flange 43. The second seal provides leakage protection that is in addition to the protection offered by the first seal, which is maintained throughout all the various orientations of closure 10. In addition to the sealing mechanism provided by the cooperation of cap body 50 and fitment 40, a third seal is provided by the cooperation between fitment 40 and container finish 80. More particularly, when fitment 40 is disposed in the opening 84 of the container finish 80, fitment sealing bead 49 engages the upper surface 88 of neck portion 82, thereby forming the third seal. This third seal prevents the contents of the container (not shown) from leaking through opening 84 and past fitment 40. As illustrated in FIGS. 7-9, annular wall 42 is connected to post 44 by three equally spaced supports 46. The contents of the container (not shown) pass between supports 46 when exiting the container.

Although fitment 40 is shown in detail in the FIGS. 7-9, it is merely representative of fitments in general, and it is to be understood that there are many variations of fitments that may be used with an embodiment of the invention.

As shown in FIGS. 2 and 4, outer wall 60 may include a thumb pad 68 disposed on an outer surface thereof. In one embodiment, outer wall 60 is formed of an appropriate polymeric material and thickness as to make it deformable. A cap body 50 including a deformable outer wall 60 may include two thumb pads 68 diametrically aligned thereon. Outer wall 60 may be deformable by the application of pressure by the user to the points on the outer wall 60 where the thumb pads 68 are disposed so as to cause outer wall 60 to deform inwardly at those points, while also deforming outwardly at points approximately 90° away from those points. In such an embodiment, child-resistant locks 61 and 63 are disposed approximately 90° away from thumb pads 68 along outer wall 60, so that, when outer wall 60 is deformed as described above, child-resistant locks 61 and 63 are moved away from child-resistant stops 81 and 83, shown in FIGS. 10-13, disposed on container finish 80, and allows counterclockwise rotation until subsequent abutment of drop lug 20 with reverse taper engages lug stop 90 on container finish 80.

As shown in FIGS. 10-14, the container finish 80 includes a neck portion 82 with an opening 84 therein, whereby the contents of the container (not shown) may be accessed. The neck portion 82 includes at least one thread 86 disposed thereon. The container finish 80 also includes at least one lug stop 90 disposed thereon. In one embodiment, the container finish 80 includes two lug stops 90 and 92 formed on a shoulder portion 94 of the container finish. Lug stop 90 is diametrically aligned with lug stop 92 along the outer surface of neck portion 82. However, depending on the desired range of rotation of the cap body 50 about the container finish 80, the container finish 80 according to one embodiment may include one or more lug stops that are disposed at various points around the container finish 80. As discussed herein below, the lug stops 90 and 92 engage reversed taper drop lugs 20 and 24 in order to limit the range of rotation of the cap body 50 about the container finish 80.

Figure 10:
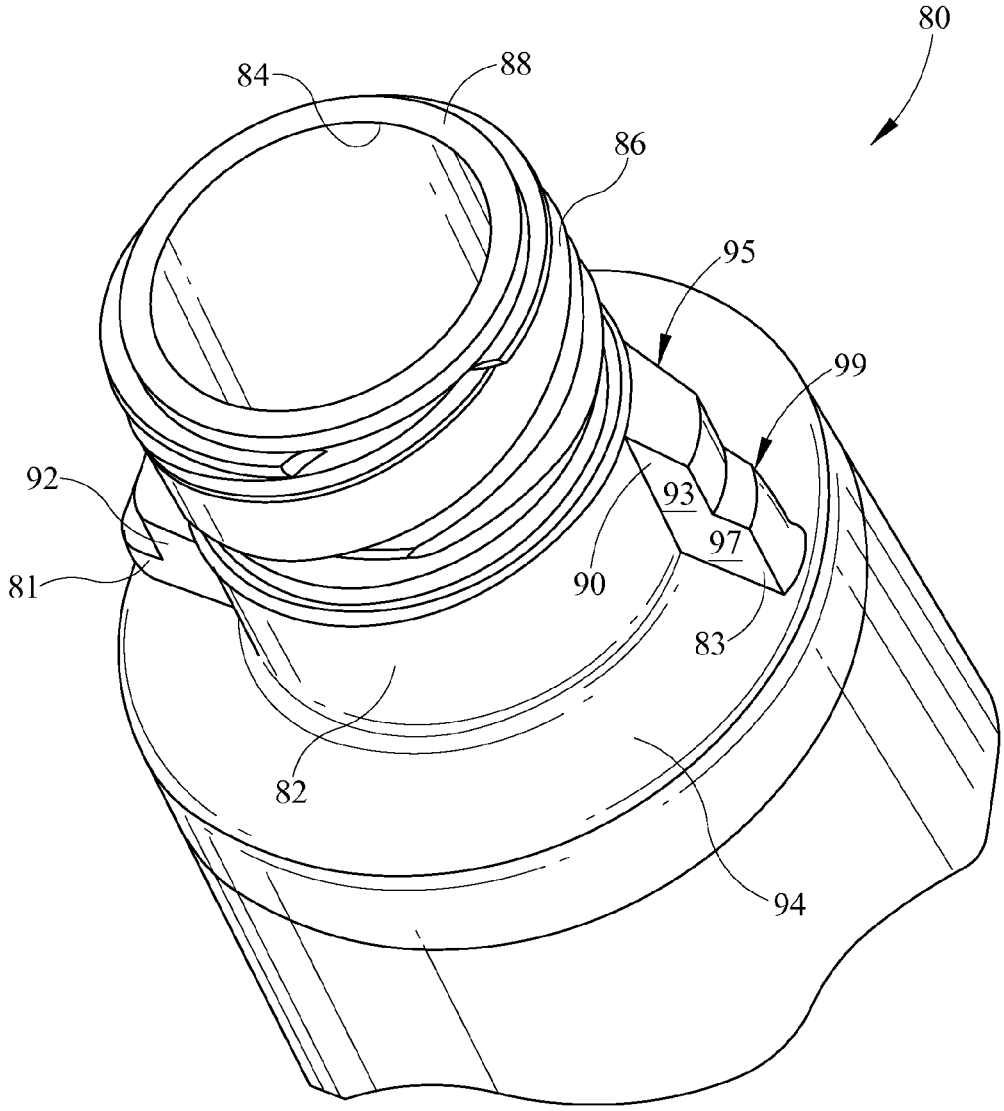
FIG. 10 is a top perspective view of the container finish according to one embodiment of the closure of FIG. 3.
Figure 11:
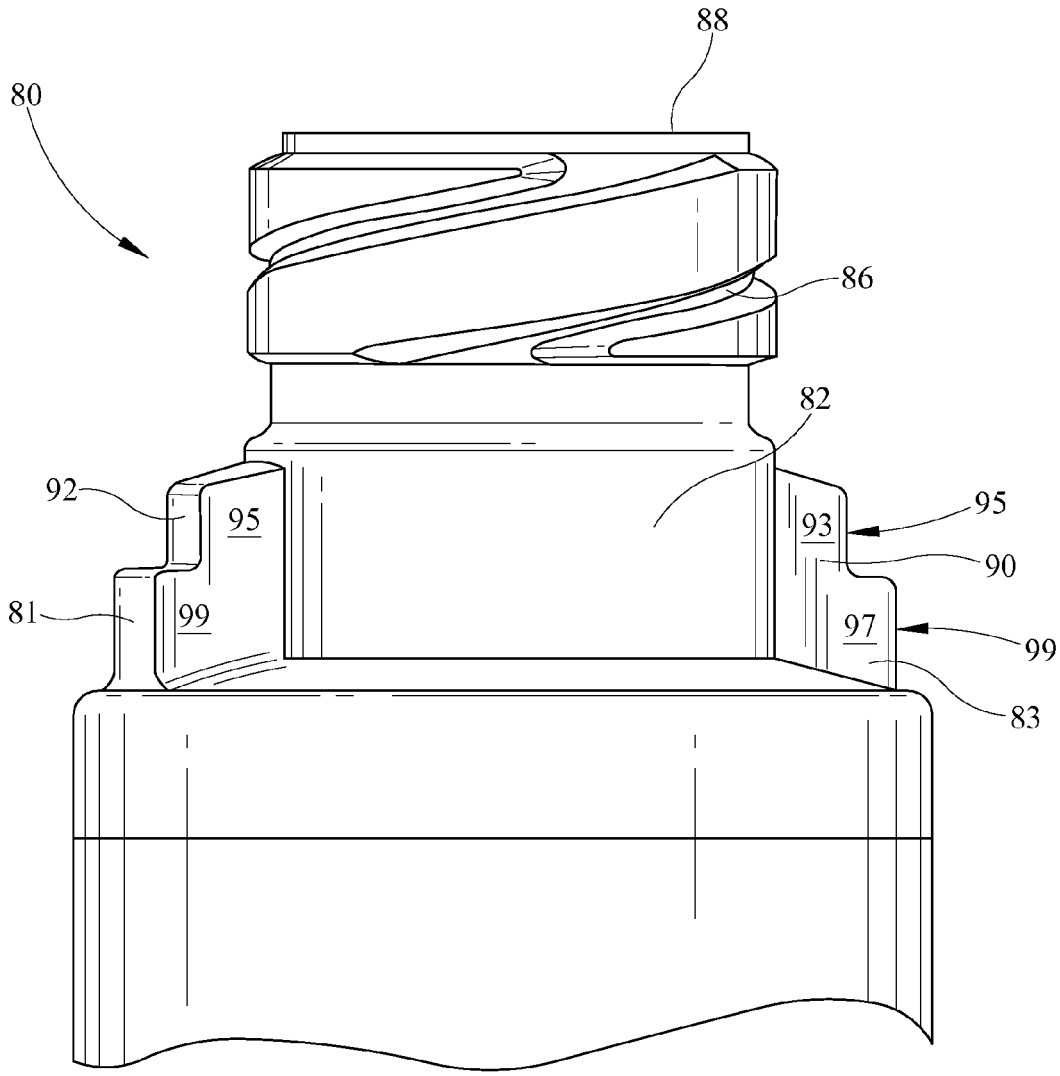
FIG. 11 is a side view of container finish of FIG. 10.
Figure 12:
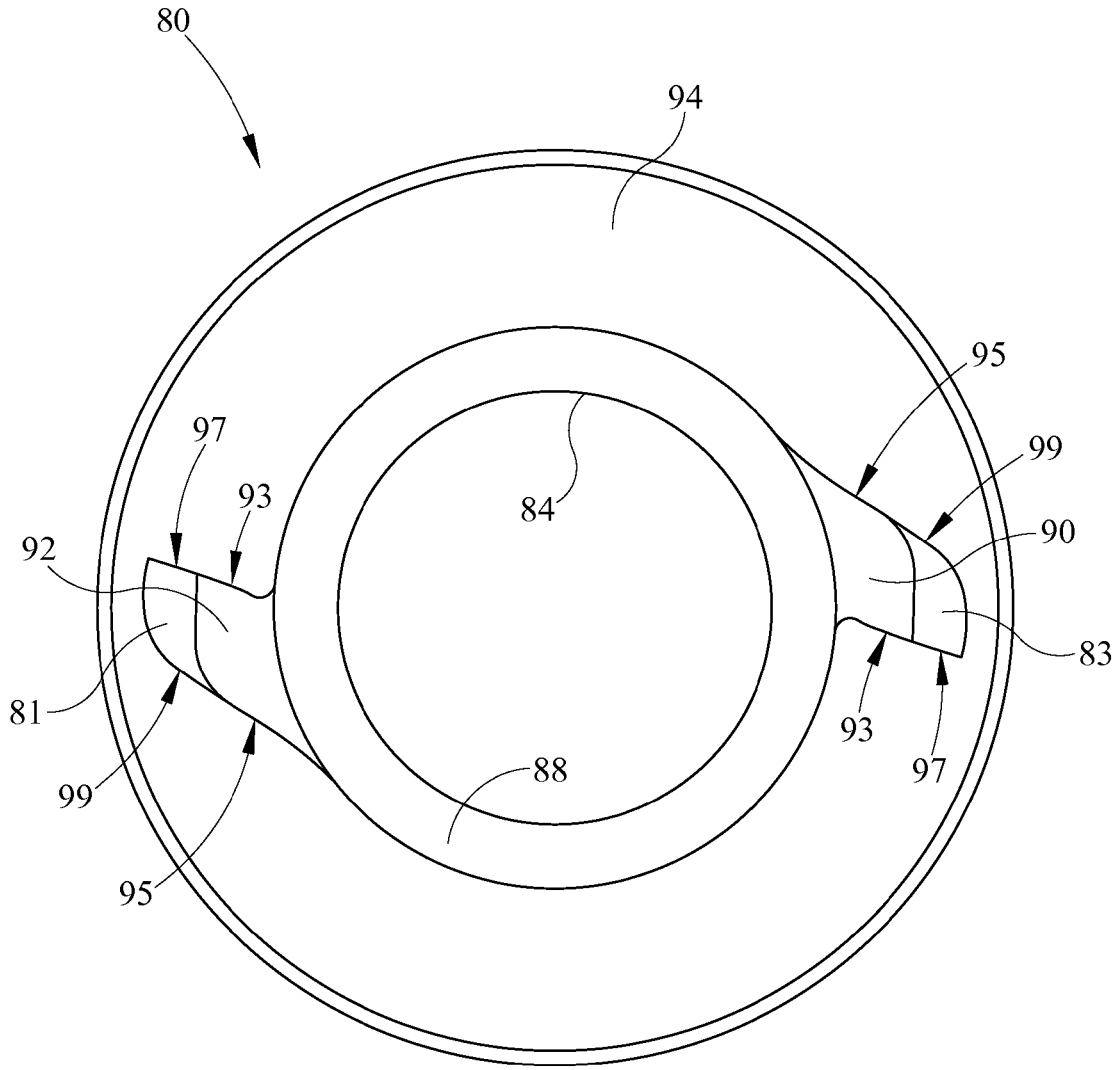
FIG. 12 is a top view of the container finish of FIG. 10.
Figure 13:
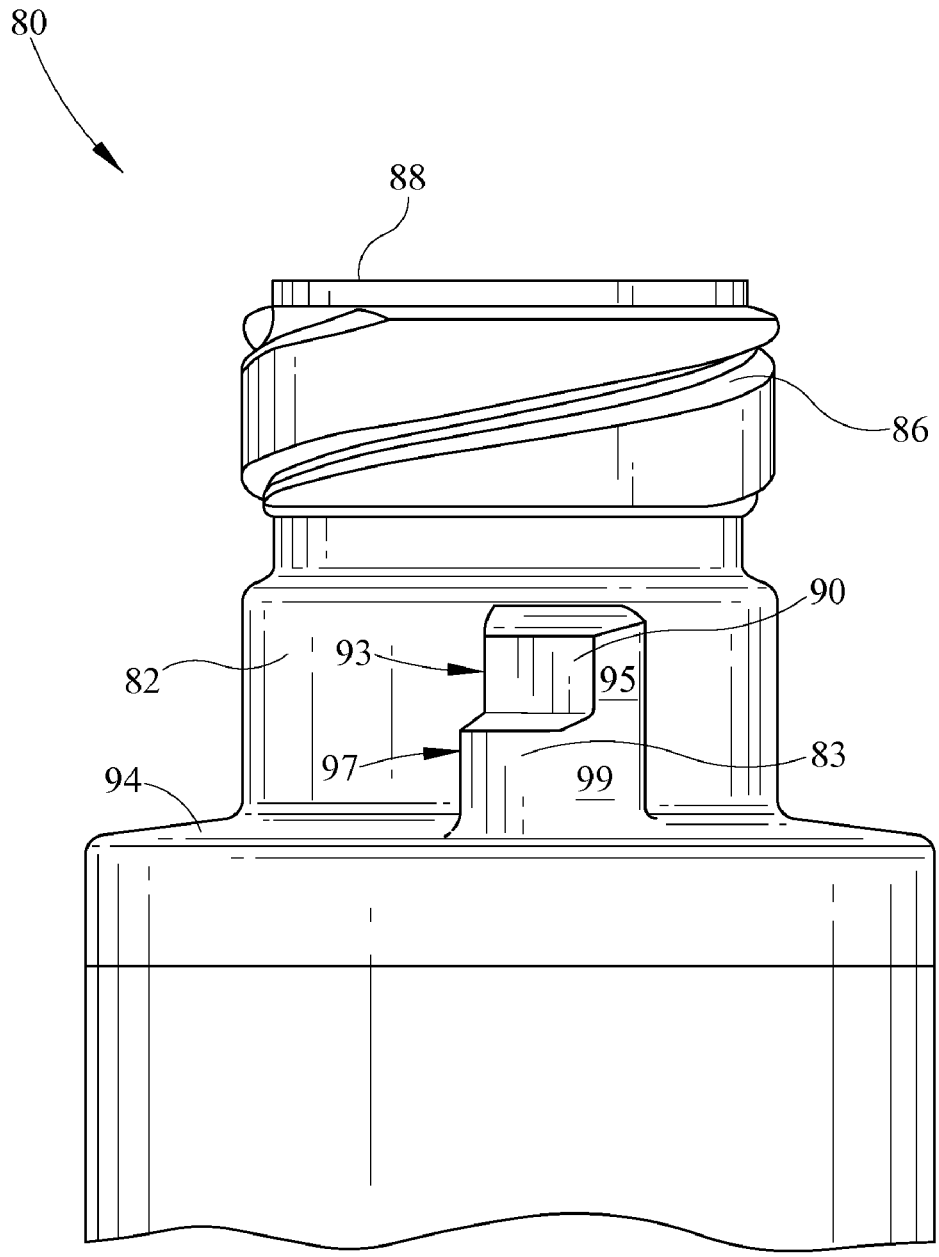
FIG. 13 is another side view of the container finish of FIG. 10.

Container finish 80 also may include at least one child-resistant stop 81 and/or 83. In one embodiment, container finish 80 includes two child-resistant stops 81 and 83 diametrically aligned around the neck portion 82 and integrally formed with lug stops 90 and 92, as shown in FIGS. 10 and 11. However, another embodiment of closure 10 may also encompass child-resistant stops that are not aligned nor integrally formed with lug stops 90 and 92. Child-resistant stops 81 and 83 cooperate with child-resistant locks 61 and 63 so as to limit the user's ability to open the closure 10, as discussed herein below. Child-resistant stops 81 and 83 differ from lug stops 90 and 92 in their size and positioning. More particularly, child-resistant stops 81 and 83 are smaller than lug stops 90 and 92 and are positioned radially beyond lug stops 90 and 92. The size and positioning of child-resistant stops 81 and 83 facilitate the proper opening of the closure 10 and allow for the lug stops 90 and 92 to engage drop lugs 20 and 24 even when outer wall 60 is being deformed so as to avoid the engagement of child-resistant stops 81 and 83 by child-resistant locks 61 and 63. As shown in FIG. 12, each of the lug stops 90 and 92 and child-resistant stops 81 and 83 may include a generally flat side and a generally rounded side. More particularly, each of lug stops 90 and 92 may include a flat side or stop surface 93, as well as a rounded side or cam surface 95. Likewise, each of the child-resistant stops 81 and 83 may also include a flat or stop surface 97, as well as a rounded or cam surface 99. The stop surfaces 93 of lug stops 90 may engage drop lugs 20 and 24 so as to stop the axial rotation of cap body 50 about neck portion 82, as illustrated in FIG. 14. However, when cam surfaces 95 of lug stops 90 and 92 engage drop lugs 20 and 24, the rounded surfaces of cam surfaces 95 allow the drop lugs 20 and 24 to slide over lug stops 90 and 92, so as to allow for the initial attachment of cap body 50 to container finish 80. Likewise, the stop surfaces 97 of child-resistant stops 81 and 83 engage child-resistant locks 61 and 63 on outer wall 60 of cap body 50, so as to prevent opening of the closure 10. Whereas, the cam surfaces 99 of child-resistant stops 81 and 83, when engaged, allow for the child-resistant locks 61 and 63 to slide over the child-resistant stops 81 and 83.

As shown in FIG. 6, drop lugs 20 and 24 are disposed approximately 90° away from each of child-resistant locks 61 and 63, so that cap body 50 may be threadably rotated only approximately 90° about the container finish 80 before either a drop lug or a child-resistant lock engages a lug stop or a child-resistant stop. In this manner, the range of rotation of the cap body 50 about the container finish 50 is limited to approximately 90°. However, an embodiment may include lugs, locks, and stops that are aligned differently so as to provide a varied range of rotation.

Although container finish 80 is shown in detail in the FIGS. 10-13, it is merely representative of containers and container finishes in general, and it is to be understood that there are many variations of container finishes that may be used with an embodiment of the invention.

In use, the closure 10 provides for the dispensing of the contents of a container (not shown). When closure 10 is assembled, fitment 40 is disposed over the opening 84 in the neck portion 82 of container finish 80. Cap body 50 is positioned over fitment 40 so that post 44 extends through spout portion 66 and seal 65 engages a surface of annular wall 42 of fitment 40. Cap body 50 is threadably attached to container finish 80 by the cooperation of at least one thread 72, on the inner surface 71 of inner wall 70, with at least one thread 86 on neck portion 82. Each of the drop lugs 20 and 24 and the child-resistant locks 61 and 63 are disposed between lug stops 90 and 92 and child-resistant stops 81 and 83. In the closed position, cap body 50 is threaded axially down over neck portion 82, such that post 44 of fitment 40 extends upward through each of opening 62, spout portion 66 and opening 67, thereby sealing opening 67 and the closure 10. When closure 10 is opened, the user applies inward pressure to the outer wall 60 at the thumb pads 68, thereby deforming the outer wall 60. The child-resistant locks 61 and 63 are disposed on the portions of the outer wall that deflect outward, when pressure is applied by the user. While this pressure is being applied, the user may then axially rotate the cap body 50, so that the cap body 50 moves upward from neck portion 82 and fitment 20. As the cap body 50 rotates axially, child-resistant locks 61 and 63 rotate past child-resistant stops 81 and 83 without engaging them, since the outer wall 60 is deformed outwardly at those points where the child-resistant locks are located. If the outer wall 60 was not deformed as the axial rotation was occurring, then child-resistant locks 61 and 63 would engage child-resistant stops 81 and 83, thereby preventing the opening of the closure 10. Nevertheless, as the child-resistant locks 61 and 63 on the deformed cap body 50 move past the child-resistant stops 81 and 83, the cap body 50 continues to rotate axially until one or both drop plugs 20 and 24 engage one or both stops 90 and 92. Once drop lugs 20 and 24 engage stops 90 and 92, further axial rotation of cap body 50 is prevented. At the point of engagement of drop lugs 20 and 24 with stops 90 and 92, closure 10 is open, but cap body 50 is still attached to container finish 80. In this manner, the dispensing closure 10 may dispense the contents of a container to which the closure 10 is attached without removing the cap body 50 from the container finish 80.

As illustrated in FIG. 3, drop lugs 20, 24 with a reverse taper maximize a lever mechanism LM to deform outer wall. When closure 10 is opened, as described above, the user applies inward pressure to outer wall 60 at thumb pads 68, thereby deforming the outer wall. The child-resistant locks 61 and 63 are disposed on the portions of outer wall 60 that deflect outward, when pressure is applied by the user. While this pressure is being applied, the cap body 50 is rotated axially to allow child-resistant locks 61, 63 to rotate past child-resistant stops 81 and 83 without engaging them. A cavity 30 exists generally at a merging or pivot area 32 between inner 70 and outer 60 walls. Reverse taper drop lug 20 allows for cavity 30 between inner 70 and outer 60 walls to remain substantially congruent. Cavity 30 is substantially at a constant depth in relation to terminating end 74 of inner wall 70. The reverse taper of drop lug 20 does not substantially bridge cavity 30 between inner 70 and outer 60 walls or substantially affect the depth of the cavity relative to the terminating end 74. If the area of cavity 30 between the reverse taper of drop lug 20 was substantially reduced, the lever mechanism LM would be minimized due to the shortened depth the lever mechanism of outer wall 70 could pivot about. Lever mechanism LM allows for the user to apply minimized inward pressure upon the thumb pads 68 in order to maximize the deformation mechanism of outer wall 70. In this manner if thumb pad 68 and reverse tapered drop lug 20 are to some extent aligned in each corresponding inner 70 and outer 60 walls, the leverage gained by the substantially congruent cavity 30 increases the performance of the outer wall's deformation to allow child-resistant locks 61, 63 to rotate past child-resistant stops 81 and 83 without engaging them. The user gains the benefit of reducing the pressure applied to the lever mechanism LM necessary to deform outer wall 70 to gain the necessary clearance of the child-resistant locks 61, 63 to rotate past the child-resistant stops 81 and 83.

The reverse taper of drop lug 20 minimizes plastic sink marks or cosmetic imperfections that form on the periphery of outer wall 60. As a result of the reverse taper of drop lug 20, a lesser amount of material mass from the drop lug is in substantial proximity or adjoined with outer wall 70. With a lesser amount of material mass from drop lug 20 in substantial proximity with outer wall 70 during the molding process, the radiant heat is lessened and substantially minimizes cosmetic imperfections or sink marks on the periphery of outer wall.

Figure 15:
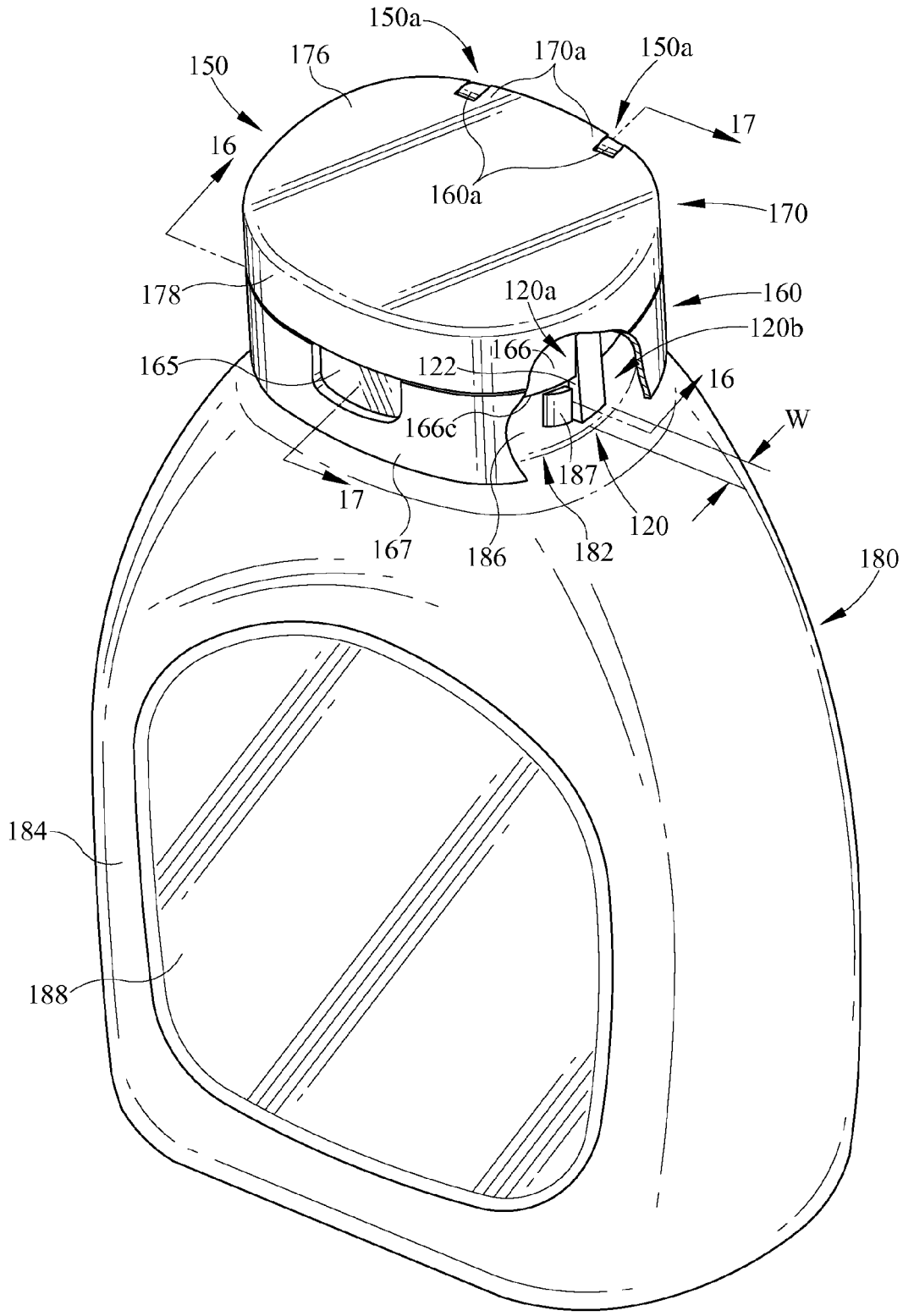
FIG. 15 is a top perspective view of another embodiment with portions of the closure partially broken away.
Figure 16:
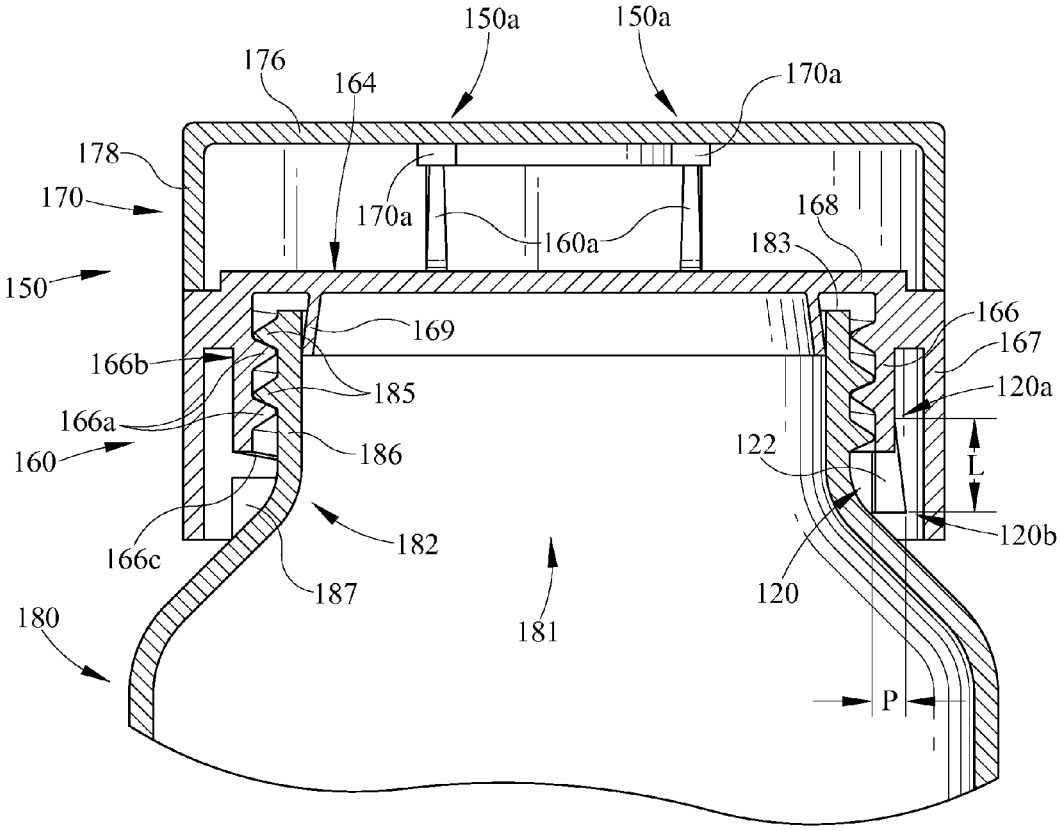
FIG. 16 is a sectional view of the closure and container finish of FIG. 15 taken along line 16-16.
Figure 17:
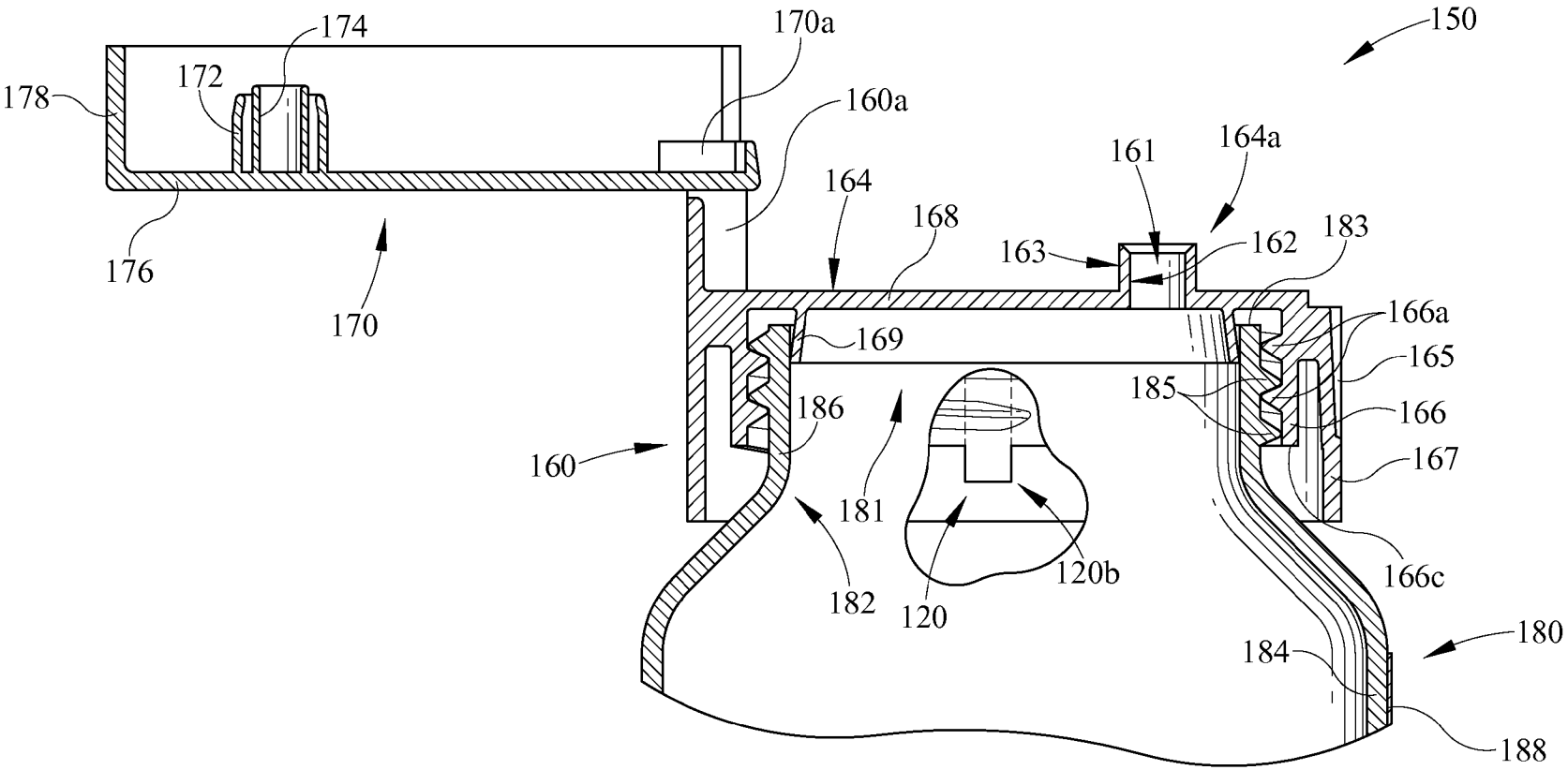
FIG. 17 is a sectional view of the closure and container finish of FIG. 15 in an open configuration taken along line 17-17 with portions of the container finish partially broken away.

Another embodiment illustrating the stopping mechanism utilizing a reverse tapered drop lug 120 is shown in FIGS. 15-17. A variety of closures, such as the flip-top closure 150 embodiment illustrated in FIGS. 15-17, utilizes the stopping mechanism in various applications with a container 180. Container 180 has a shoulder narrowing to a container neck finish 182 comprising a neck 186 that is of sufficient length to accommodate an external thread 185 for threaded engagement of flip-top closure 150 with the container. At the top of neck 186 is an opening 181 permitting access to the contents of container 180. At least one lug stop 187 (FIGS. 15 and 16) is provided at the base of neck 186, adjacent the shoulder. Alternatively two such lug stops may be provided, on opposing sides of neck 186. Flip-top closure 150 is threaded axially upon container neck finish 182 until subsequent abutment of at least one drop lug 120 with reverse taper engages at least one lug stop 187. Drop lug 120 may act as a barrier to prevent flip-top closure 150 from being seated too far down upon container neck finish 182; it may also be used to align or orient the closure with respect to a label 188 or a particular container side, such as a front side 184 of container 180, or orient the closure relative to the container's shape. Although container 180 is shown in detail in FIGS. 15-17, it is merely representative of containers in general, and it is to be understood that there are a variety of containers of different shapes, sizes, and neck finishes that may be used with the closure embodiments herein.

As illustrated in FIGS. 15-17, flip-top closure 150 includes a closure base or body 160 and a lid 170. Lid 170 is connected to body 160 by hinge 150*a* which accommodates movement of lid 170 from a closed position (FIGS. 15 and 16) to an open position (FIG. 17) while maintaining a secure attachment of lid 170 to closure body 160. As shown in FIGS. 15 and 16, hinge 150*a* can be used to join a two piece molded flip-top closure. For example, hinge 150*a* may comprise a pair of arms 160*a* integrally molded with body 160. Arms 160*a* can then connect to the separately molded lid 170 at slotted abutments 170*a* which are integrally molded with lid 170. Alternately other types of hinge means known in the art, including but not limited to a living hinge type, may be used to connect lid 170 and body 160. As shown in FIGS. 15-17, closure body 160 may comprise an inner shell 166 and an outer shell 167, both depending from a top wall 168. Inner shell 166 is adapted to removably or fixedly receive the upper end or neck 186 of container 180. The interior surface of inner shell 166 includes suitable connecting means, such as a conventional thread 166*a* adapted for threaded engagement with a mating container thread 185 as illustrated in FIG. 16. As shown in FIGS. 15-17, inner shell 166 also comprise at least one drop lug 120 adapted to engage lug stop 187 on container neck 186 at the appropriate position of rotation of closure 150 to provide the desired alignment of closure 150 with container 180. Specifically when flip-top closure 150 is rotated clockwise onto the threaded container finish 182 of container 180, drop lug 120 depending from inner shell 166 is threaded down to the point where drop lug 120 engages with the corresponding and interfering lug stop 187. Upon being seated as desired on container finish 182, flip-top closure 150 will be properly oriented with respect to container 180 because of the corresponding drop lug and lug stop engagement. The position of engagement of the drop lug and lug stop may be varied to insure that closure body orifice 161 will be oriented properly relative to container 180. Outer shell 167 may be designed with a variety of shapes and sizes, including being the same as inner shell 166. However as shown in the FIG. 15, outer shell 167 may also be shaped to conform to the shape of container 180, which in the embodiment illustrated is substantially oval.

Although flip-top closure 150 is shown in detail in FIGS. 15-17, it is to be understood by those skilled in the art that a variety of closures, either dispensing or non-dispensing, may be provided in any number of different shapes and sizes and still function to have a reverse tapered drop lug 120 depending from the inner shell.

Additionally, the position of engagement of drop lug 120 with lug stop 187 may in some cases limit the axial distance traveled by flip-top closure 150 along container finish 52, so that a clearance will be left between top wall 168 and container lip 183, possibly allowing leakage from inside container 180. To prevent such leakage, a plug seal 169 (FIGS. 16 and 17) or a variety of different radial seals can be formed to depend from top wall 168 of closure body 160 in position to engage the interior of container neck 186 when closure 150 is engaged with container finish 182. In other words, when closure 150 is seated upon container finish 182 to the point where drop lug 120 and stop lug 187 engage (FIG. 15), possibly to orient closure 150 to front side 184 of the container, plug seal 169 can engage and seal the interior of container neck opening 181.

As shown in FIGS. 15 and 17, the exterior of outer shell 167 of closure body 160 includes a thumb recess 165. Positioned above thumb recess 165, the top of closure body 160 defines a peripheral deck or top surface 164. Extending upwardly from top surface 164 of closure body 160 may be a spout 164*a*. Spout 164*a* defines closure body orifice 161 through top wall 168 creating a dispensing channel from within the container 180. The lateral walls of spout 164*a* have an inner surface 162 and an opposing outside surface 163. Inner and outer surface 162 and 163 form a dispensing channel through the upstanding lateral walls of spout 164*a*. When lid 170 is in the open configuration (FIG. 17), orifice 161, defined by spout 164*a*, permits contents to travel out of the container opening 181. Orifice 161, with or without spout 164*a*, may be provided in any number of sizes, positions, and shapes including circular or oval, as will be recognized by one skilled in the art.

In the closed configuration (FIGS. 15 and 16), lid 170 may provide the means for sealing orifice 161 of closure body 160. Lid 170 has a central portion or deck 176 and a depending, peripheral skirt 178. At the front of lid skirt 178 in registry above thumb recess 165 (FIG. 15), there may be an outwardly projecting thumb or finger lid lift (not shown). The user may initially lift lid by applying an upward force with a finger or thumb to a portion of lid skirt 178 accessible because of the opening created by thumb recess 165. Lid 170 may be rotated to a fully opened position as shown in FIG. 17 to open the entrance to orifice 161. Also depending from the bottom surface of lid deck 176 is a sleeve or seal 172, alone or in combination with a plug 174. Sleeve 172 depends from lid deck 176 and engages the periphery or outer surface 163 of spout 164*a*, or alternatively sleeve 172 may engage inner surface 162 of spout 164*a* (not shown). In opposing relation to sleeve 172 during engagement of spout 164*a*, plug 174 depends from lid deck 176 in a co-axial relationship with sleeve 172, and engages the opposite surface of the spout than that which the sleeve contacts. As shown in the FIG. 17, plug 174 may engage inner surface 162 of spout 164*a*. Sleeve 172 and plug 174 may also each be provided with a chamfered free end or have a radiused tip to facilitate entry when either is used to engage spout 164*a*. Both sleeve 172 and/or plug 174 will be provided with a substantially congruent shape to that of the dispensing spout 164*a*.

As described above and shown in FIGS. 15-17, at least one drop lug 120 is reverse tapered and projects down from an outside surface 166*b* of inner wall 166. A free end 120*b* of drop lug 120 may pass through and extend beyond a lower portion or termination edge 166*c* of inner wall 166. Drop lug top end 120*a* merges into outside surface 166*b* of inner wall 166. A larger profile P is provided at bottom end 120*b* of drop lug 120 and creates an abutment surface 122 which has an increased surface area adapted to resist deformation as the rotational pressure increases once contact between drop lug 120 and lug stop 187 begins. As shown in FIG. 16, deformation of drop lug 120 is also minimized by the gradual increase in profile P of the drop lug as a result of its reverse tapering from narrow to wide in the direction away from inner wall 166 over length L. The extent of the reverse tapered connection between drop lug 120 and inner wall 166, plus the overall width W (FIG. 15) and length L (FIG. 16) of drop lug 120 including the larger profile P at bottom end 120*b*, imparts to drop lug 120 sufficient rigidity to resist deformation as rotating pressure is applied to closure 150, pressing abutment surface 122 of drop lug 120 against stop lug 187. Any number of shapes and dimensioning of width W, length L, and profile P for reverse taper drop lug 120 may be used and still fall within the spirit of an embodiment of the invention. Drop lug 120 may be provided in various reverse tapered shapes in cross section.

A variety of dispensing or non-dispensing closures, having either round or non-round outer periphery shapes, may utilize the stopping mechanism with reverse taper drop lug 120 to align or orient the closure to a particular structure of the container. For example, the flip-top closure as shown in FIGS. 15-17 has orifice 161 positioned towards a particular side of the container, which in the embodiment illustrated is adjacent the front side 184 or label 188 of the container. Another embodiment may be a dispensing or non-dispensing closure having an outer periphery substantially ovalized and subsequently placed upon container finish of a congruently shaped container. This embodiment is shown in FIGS. 15-17 where the oval shaped flip-top closure 150 can be seated in congruent shape relationship with container 180 by means of a reverse taper drop lug 120 and lug stop 187 while being threadably secured to the container. Another example of orientation may apply when a round shaped dispensing or non-dispensing closure includes instructions, symbols, or other tamper-indicating mechanisms which are required to be oriented to a particular surface or label of the container. Also, a closure latch mechanism with a push button may be variously orientated by means of a reverse taper drop lug 120 and lug stop 187 in a variety of applications.

Reverse taper drop lug 120 may also act as a barrier to prevent flip-top closure 150 from being seated too far down upon container neck finish 182. This may be used to provide space for accommodating, for example, various types of liners including re-seal liners positioned to engage container lip 183, the use of malleable seal materials positioned along the inner surface of top wall 168, foil seals, or other seals known to those skilled in the art. Alternatively, plug seal 169 (FIGS. 16 and 17) in one embodiment can serve to seal-in the contents of container 180 without need for additional liners, malleable seal materials, foil seals or other types of seals for seating the closure in contact with container lip 183. In fact a flip-top closure 150 with reverse taper drop lug 120 and plug seal 169, may serve to seal a linerless container from the time the contents are received into the container and for the duration of the useful life of the container.

The use of a drop lug with reverse taper reduces assembly complications at the time of initial application of the closure to the container and thru the repeated application of the closure to the container during the useful life of the container. Specifically, at the time of assembling the closure with the container, the capping torque applied to the closure may be sporadic and is not a precisely controllable variable. In such case the use of a reverse taper drop lug provides sufficient strength to resist over-torque during the capping process. The reverse taper drop lug thus reduces the potentially deleterious effects of over-torque, for example, preventing the over tightening of the closure and reducing the potential breakage of drop lugs; it also serves to consistently orient the closure in relation to the container.

It is understood that while certain embodiments of the invention have been illustrated and described, it is not limited thereto except insofar as such limitations are included in the following claims and allowable functional equivalents thereof.

What is claimed is:

1. The flip-top closure for a container comprising:

a closure body and a lid hingedly connected thereto, wherein said closure body has a top wall having a depending inner shell and an outer shell, and said top wall has a dispensing orifice;

said inner shell having an outside surface and an inside surface said inside surface having a thread for engagement with a neck of the container;

said inner shell having at least one depending drop lug having a free end and an opposing distal end, said free end of said at least one drop lug extending through a terminating edge of said inner shell, said distal end of said at least one drop lug tapering into said outside surface of said inner shell adjacent said terminating edge of said inner shell;

said distal end of said at least one drop lug having a first thickness and said free end of said at least one drop lug having a second thickness; and said second thickness of said free end is greater than said first thickness of said distal end thereby creating a larger abutment surface at said free end for contact a lug stop of the container neck for preventing continued rotation of said closure upon the container neck during application of said closure upon said container.

2. The flip-top closure as in claim 1 wherein said closure being non-round in shape.

3. The flip-top closure as in claim 1 further including said container, wherein said at least one drop lug of said inner shell orients said flip-top closure relative to said container when applied upon said container.

4. The flip-top closure as in claim 1 wherein said top wall further comprises includes a depending radial plug seal sealingly engaging an opening defined by said container neck.

5. The flip-top closure as in claim 1 further including said container, wherein said at least one drop lug of said inner shell orients said dispensing orifice relative to said container when closed upon said container.

6. The flip-top closure as in claim 1 further including said container, wherein said at least one drop lug of said inner shell orients at least one latch mechanism of said flip-top closure relative to said container when applied upon said container.

* * * * *